US005996361A

United States Patent [19]

Bessler et al.

[11] Patent Number: 5,996,361

[45] Date of Patent: Dec. 7, 1999

[54] REFRIGERATION SYSTEM

[75] Inventors: Warren Frank Bessler, Amsterdam; Frank Joseph Bowden, Latham, both of N.Y.

[73] Assignee: General Electric Company, Schenectady, N.Y.

[21] Appl. No.: 09/066,660

[22] Filed: Apr. 27, 1998

[51] Int. Cl.[6] ..... F25B 49/02

[52] U.S. Cl. ..... 62/163; 62/156; 62/180; 62/187; 62/229

[58] Field of Search ..... 692/179, 180, 692/186, 187, 151, 155, 156, 203, 208, 161, 163, 229, 181, 183

[56] References Cited

U.S. PATENT DOCUMENTS

| | | | |
|---|---|---|---|
| 4,481,787 | 11/1984 | Lynch | 62/229 X |
| 4,689,966 | 9/1987 | Nonaka | 62/163 X |
| 4,732,010 | 3/1988 | Linstromberg et al. | 62/187 |
| 4,821,528 | 4/1989 | Tershak | 62/187 X |
| 5,471,849 | 12/1995 | Bessler | 62/186 |

*Primary Examiner*—Harry B. Tanner
*Attorney, Agent, or Firm*—Patrick K. Patnode; Marvin Snyder

[57] ABSTRACT

A control circuit for a refrigeration system disposed within an outer cabinet having a freezer compartment, a fresh food compartment, a compressor, a condenser fan, an evaporator fan, an evaporator and a freezer thermostat disposed within the freezer compartment to sense temperature therein. Additionally, a fresh food thermostat is disposed within the fresh food compartment to sense temperature therein. A freezer thermostat switch is switched between an open state and a closed state in response to temperature signals generated from the freezer thermostat. A fresh food thermostat switch is switched between an open state and a closed state in response to temperature signals generated from the fresh food thermostat. An energy saver switch is disposed between the fresh food thermostat switch and a power source, which energy saver switch is switched between an open state and a closed state. If the energy saver switch is disposed in an open position and the fresh food thermostat demands cooling the fresh food switch is switched to a closed position and the compressor and the condenser fan are not energized. If, however, the energy saver switch is disposed in a closed position and the fresh food thermostat demands cooling the fresh food switch is switched to a closed position and the compressor and the condenser fan are energized.

19 Claims, 10 Drawing Sheets

REFRIGERATION SYSTEM

BACKGROUND OF THE INVENTION

This application relates to refrigeration systems and more particularly relates to energy saving refrigeration systems.

Household refrigerators typically operate on a simple vapor compression cycle. Such a cycle typically includes a compressor, a condenser, an expansion device, and an evaporator connected in series and charged with a refrigerant. The evaporator is a specific type of heat exchanger that transfers heat from air passing over the evaporator to refrigerant flowing through the evaporator, thereby causing the refrigerant to vaporize. The cooled air is then used to refrigerate one or more freezer or fresh food compartments.

The temperatures in the compartments gradually rise due to heat transfer through the walls and doors of the refrigerator as well as from door openings and the loading of food items therein. Temperature gradients and moisture condensation typically occur in fresh food compartments of household refrigerators. Moisture accumulates on surfaces colder than average that are situated in areas of stagnant airflow. Temperature gradients occur due to the on-off cycling of the hermetic cooling system. The application of electric surface heaters and secondary air recirculation fans to combat these problems adds cost to the system and are no longer acceptable due to energy conservation standards.

Therefore, it is apparent from the above that there exists a need in the art for an independent fresh food and freezer temperature control and for moisture and temperature gradient reduction within refrigeration systems.

SUMMARY OF THE INVENTION

A control circuit for a refrigeration system disposed within an outer cabinet having a freezer compartment and a fresh food compartment, a compressor, a condenser fan, an evaporator fan, an evaporator and a freezer thermostat disposed within the freezer compartment to sense temperature therein. Additionally, a fresh food thermostat is disposed within the fresh food compartment to sense temperature therein. A freezer thermostat switch is switched between an open state and a closed state in response to temperature signals generated from the freezer thermostat. A fresh food thermostat switch is switched between an open state and a closed state in response to temperature signals generated from the freezer thermostat. An energy saver switch is disposed between the fresh food thermostat switch and a power source, which energy saver switch is switched between an open state and a closed state. If the energy saver switch is disposed in an open position and the fresh food thermostat demands cooling the fresh food switch is switched to a closed position and the compressor and the condenser fan are not energized. If, however, the energy switch is disposed in a closed position and the fresh food thermostat demands cooling the fresh food switch is switched to a closed position and the compressor and the condenser fan are energized.

DETAILED DESCRIPTION OF THE INVENTION

Figure 1:
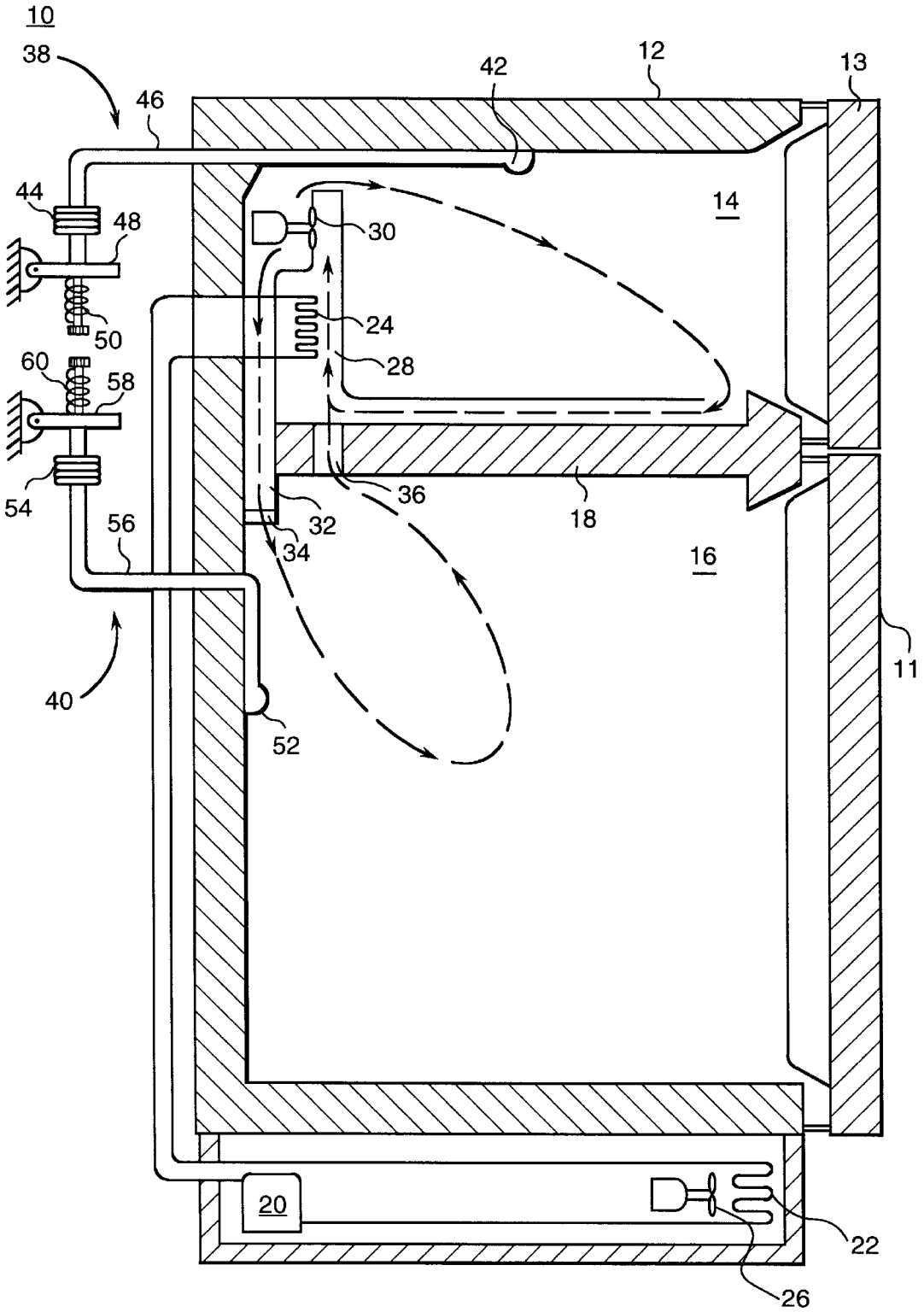
FIG. 1 is a schematic cross-sectional elevation view of an illustrative embodiment of the instant invention.

A refrigeration system 10 comprises an outer cabinet 12 having a fresh food door 11 and a freezer door 13 and an internal freezer compartment 14 and fresh food compartment 16 separated by a partition wall 18, a shown in FIG. 1. Freezer compartment 14 and fresh food compartment 16 are maintained at the desired temperature levels by a refrigeration system that comprises a compressor 20, a condenser 22 and an evaporator 24 connected in fluid communication and charged with a refrigerant. An expansion device (not shown) is connected between the condenser 22 and the evaporator 24. A condenser fan 26 is situated adjacent to condenser 22 and forces air to flow over condenser 22 to promote heat transfer. Although refrigerator 10 shown in FIG. 1 is a top mount refrigerator, it should be noted that the present invention is equally applicable to other types of refrigerators, such as the well known side-by-side design.

Evaporator 24 is located within a chamber 28 situated in the rear of freezer compartment 14. An evaporator fan 30 is positioned adjacent evaporator 24. Evaporator fan 30 draws air from the freezer compartment 14 into the chamber 28 and forces the air over evaporator 24 so as to discharge cooled air into freezer compartment 14. Some of the air cooled by evaporator 24 is diverted through an air passage 32 into fresh food compartment 16. A damper 34 is provided in air passage 32 to regulate the flow of air into fresh food compartment 16. The division of cooling air is such that freezer compartment 14 is maintained at below freezing temperatures and fresh food compartment 16 is maintained at food preserving temperatures. Air is returned to chamber 28 from the fresh food compartment 16 via a return duct 36 in partition wall 18.

Refrigerator 10 includes a freezer temperature sensor 38 and a fresh food temperature sensor 40. By way of example, temperature sensors 38, 40 are shown as expansable gas type thermostats although other types of temperature sensors may be utilized including RTD's, thermocouples or the like. Freezer temperature sensor 38 has a temperature sensing element 42 located in freezer compartment 14. Temperature sensing element 42 is typically a bulb containing a volatile fluid which is connected to an expandable bellows 44 by a capillary tube 46. Bellows 44 expands and contract as the temperature in freezer compartment 14 increases and decreases. An actuating arm 48 is arranged to move between first and second positions in response to expansion and contraction of the bellows 44. Actuating arm 48 assumes the first position as long as the temperature in freezer compartment 14 is below a predetermined level and moves with snap action into the second position when the temperature in the freezer compartment 14 exceeds the predetermined level. The temperature at which actuating arm 48 switches position (referred to herein as the "preset temperature level") may be varied by means of an adjustable spring 50.

Fresh food thermostat 40 is similar to freezer thermostat 38 and includes a temperature sensing element 52 located in fresh food compartment 16 that is connected to a bellows 54 by a capillary tube 56. An actuating arm 58 is controlled by bellows 54 in response to temperature changes in fresh food compartment 16. The preset temperature level at which actuating arm 58 switches between its first and second positions may be varied by means of an adjustable spring 60. Fresh food thermostat 40 also controls the opening and closing of damper 34, where damper 34 is closed when actuating arm 58 is in the first position, and damper 34 is opened when actuating arm 58 is in the second position. Actuating arm 58 can either be mechanically linked to damper 34 to directly manipulate damper 34, or actuating arm 58 can activate a motor arranged to open and close damper 34. Although schematically shown outside of the refrigerator for ease of illustration, thermostats 38, 40 are normally contained within refrigerator cabinet 12 with control knobs (not shown) for adjusting springs 50, 60 being accessible through the fresh food compartment 16.

Figure 2:
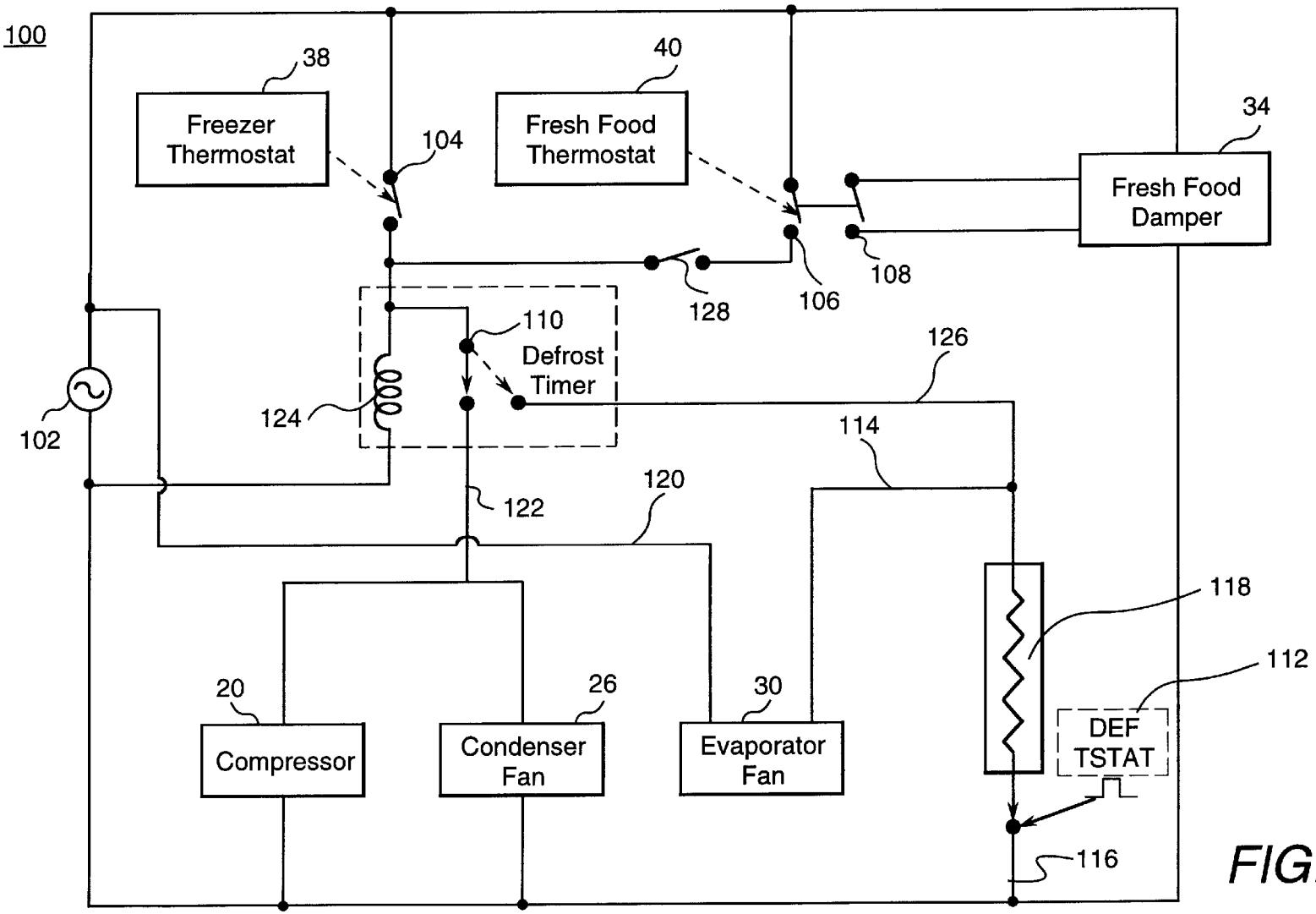
FIG. 2 is a schematic diagram of a first embodiment of a control circuit in accordance with one embodiment of the instant invention.

In accordance with one embodiment of the instant invention, a refrigeration control circuit 100 includes a power source 102, a freezer thermostat switch 104, a fresh food thermostat switch 106, a fresh food damper switch 108, a defrost timer switch 110, and a defrost thermostat 112, as shown in FIG. 2.

Defrost thermostat 112, typically a bimetal temperature switch is ordinarily a closed switch connecting a branch 114 to a branch 116 through a heater 118. Accordingly, in this embodiment, evaporator fan 30 is continuously energized through a branch 120 by power source 102 as long as defrost thermostat 112 is in a closed switch position. Continuous fan operation promotes uniform temperatures throughout both compartments by circulating air during the compressor off cycle. This continuous operation also helps to prevent internal condensation on the cabinet walls of the fresh food compartment by maintaining air currents over these surfaces.

Freezer thermostat switch 104 is switched between an open state and a closed state in response to freezer thermostat 38. Specifically, when freezer thermostat 38 is satisfied (the temperature in freezer compartment 14 is below a preset freezer temperature level), freezer thermostat switch 104 is in an open position. Alternatively, when freezer thermostat 38 demands cooling (the temperature in freezer compartment 14 is above a preset freezer temperature level), freezer thermostat switch 104 is switched to a closed position. When freezer thermostat switch 104 is switched to a closed position, a branch 122 is energized by power source 102 and in turn compressor 20 and condenser 26 are energized. Compressor 20 and condenser fan 26 remain energized until freezer thermostat 38 is satisfied and freezer thermostat switch 104 switches back to an open position disconnecting branch 122 from power source 102.

A timer motor 124 runs whenever compressor 20 is energized and accumulates compressor run time. After a predetermined amount of compressor run time, defrost timer switch 110 switches to a second state so as to energize branch 126 and heater 118. When the voltage from defrost timer switch 110 is applied to heater 118, evaporator fan 30 stops running because the line voltage is equalized on both sides of evaporator fan 30 within circuit 100. Heater 118 heats evaporator 24 (FIG. 1) and freezer compartment 14 to melt unwanted ice buildup thereon. When defrost thermostat 112 (FIG. 2) reaches a predetermined temperature set point, thermostat 112 switches to an open position and heater 118 is disabled. When timer motor 124 indexes the timer through the defrost period, compressor 20 and condenser fan 26 are energized. After the evaporator cools, evaporator fan 30 is again energized as defrost thermostat 112 switches back to a closed position and the equalized voltage is removed from fan 30.

Fresh food thermostat switch 106 is switched between an open state and a closed state in response to fresh food thermostat 40. Specifically, when fresh food thermostat 40 is satisfied (the temperature in fresh food compartment 16 is below a preset fresh food temperature level), fresh food switch 106 is in an open position. Alternatively, when fresh food thermostat 40 demands cooling (the temperature in fresh food compartment 16 is above a preset fresh food temperature), fresh food switch 106 is switched to a closed position. When fresh food thermostat switch 106 is switched to a closed position, branch 122 is energized by power source 102 and in turn compressor 20 and condenser fan 26 are energized. Compressor 20 and condenser fan 26 remain energized until fresh food thermostat 40 is satisfied and fresh food thermostat switch 106 switches back to an open position disconnecting branch 122 from power source 102. Fresh food damper switch 108 and fresh food thermostat switch 106 typically comprise a double pole single throw switch such that when fresh food thermostat switch 106 is switched between states, fresh food damper switch 108 is correspondingly switched between states. Accordingly, when fresh food thermostat switch 106 is in an open position, fresh food damper switch 108 is also in an open position and fresh food damper 34 is not energized. When fresh food thermostat switch 106 is in a closed position, fresh food damper switch 108 is also in a closed position and fresh food damper 34 is energized.

In accordance with one embodiment of the instant invention, an energy saver switch 128 is disposed between fresh food thermostat switch 106 and branch 122. Energy saver switch 128 is typically a slide switch disposed such that it is accessible to a system user. If a system user selects an energy savings mode of operation, energy saver switch 128 is moved to an open position. When energy saver switch 128 is in an open position and fresh food thermostat 40 demands cooling, fresh food switch 106 is switched to a closed position, branch 122 is not energized and in turn compressor 20 and condenser fan 26 are not energized. Accordingly, when a system user slides energy saver switch 128 to an open position fresh food thermostat 40 is prevented from activating the hermetic loop, thereby saving energy.

Since fresh food thermostat switch 106 and fresh food damper switch 108 are correspondingly switched between states, when fresh food switch 106 is switched to a closed position, damper switch 108 is also switched to a closed position. Accordingly, fresh food damper 34 is energized enabling damper 34 to move between an open and closed position to selectively allow cool air from freezer compartment to fresh food compartment.

Therefore, when energy saver switch 128 is opened by a system user, fresh food thermostat 106 cannot activate the hermetic loop. Fresh food compartment 16, therefore, must utilize cool air from freezer compartment to cool contents therein through passage 32.

Figure 3:
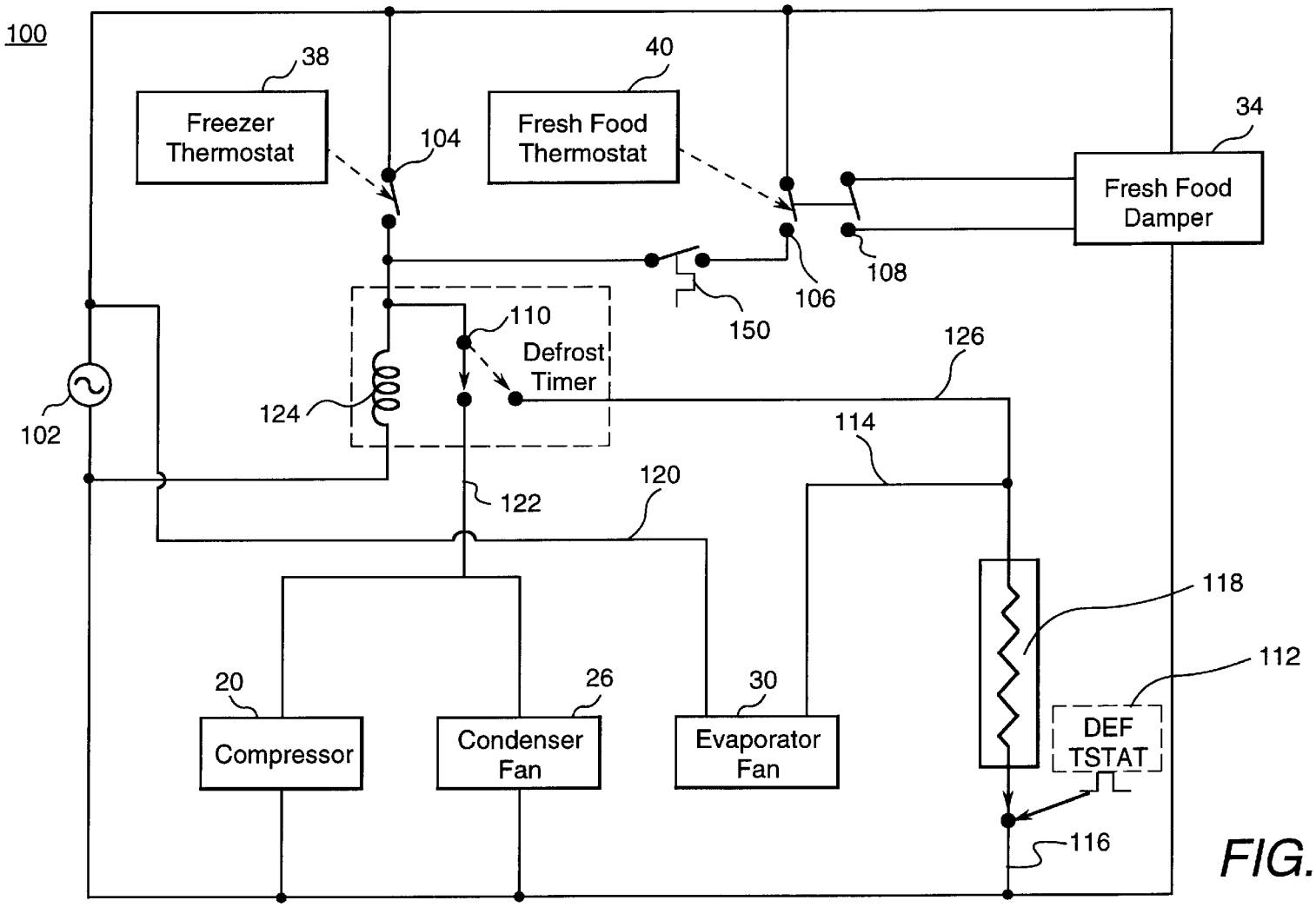
FIG. 3 is another schematic diagram of a control circuit in accordance with another embodiment of the instant invention.

In accordance with another embodiment of the instant invention, a fresh food interlock switch 150 is disposed between fresh food thermostat switch 106 and branch 122, as shown in FIG. 3.

Fresh food interlock switch 150 is typically a bimetal switch disposed adjacent to a suction line return to compressor 20. When fresh food interlock switch 150 is in an open position and fresh food thermostat 40 demands cooling, fresh food thermostat switch 106 is switched to a closed position, but branch 122 is not energized and in turn compressor 20 and condenser fan 26 are not energized. Accordingly, if fresh food thermostat 106 calls for cooling, only damper 34 will open and compressor 20 and condenser fan will not be activated.

When freezer thermostat 38 demands cooling, freezer thermostat switch 104 is switched to a closed position and branch 122 is energized by power source 102 and in turn compressor 20 and condenser fan 26 are energized. When compressor 20 is energized and cooling begins, the suction line return to compressor 20 cools down. If the suction line return temperature drops below a preset temperature, fresh food interlock switch 150 will switch to a closed position.

If fresh food interlock switch 150 is switched to a closed position, and fresh food thermostat 40 is also calling for cooling, i.e. fresh food thermostat switch is in a closed position, fresh food interlock switch 150 will remain in a closed position until both freezer thermostat 38 and fresh food thermostat 40 are satisfied. Once freezer thermostat 38 is satisfied, freezer thermostat switch 104 will switch back to an open position. If fresh food thermostat 40 is simultaneously calling for cooling, fresh food interlock switch 150 will remain in a closed position allowing fresh food thermostat to control the hermetic loop. Once fresh food thermostat 40 is satisfied, fresh food thermostat switch 106 will switch back to an open position and fresh food interlock switch 150 is switched back to an open position as the suction line warms.

This fresh food interlock embodiment prevents excessive compressor cycling by allowing fresh food thermostat 40 to have control of the hermetic loop only when compressor is already in use to satisfy freezer thermostat 38. This feature saves energy by reducing cycling losses.

Figure 4:
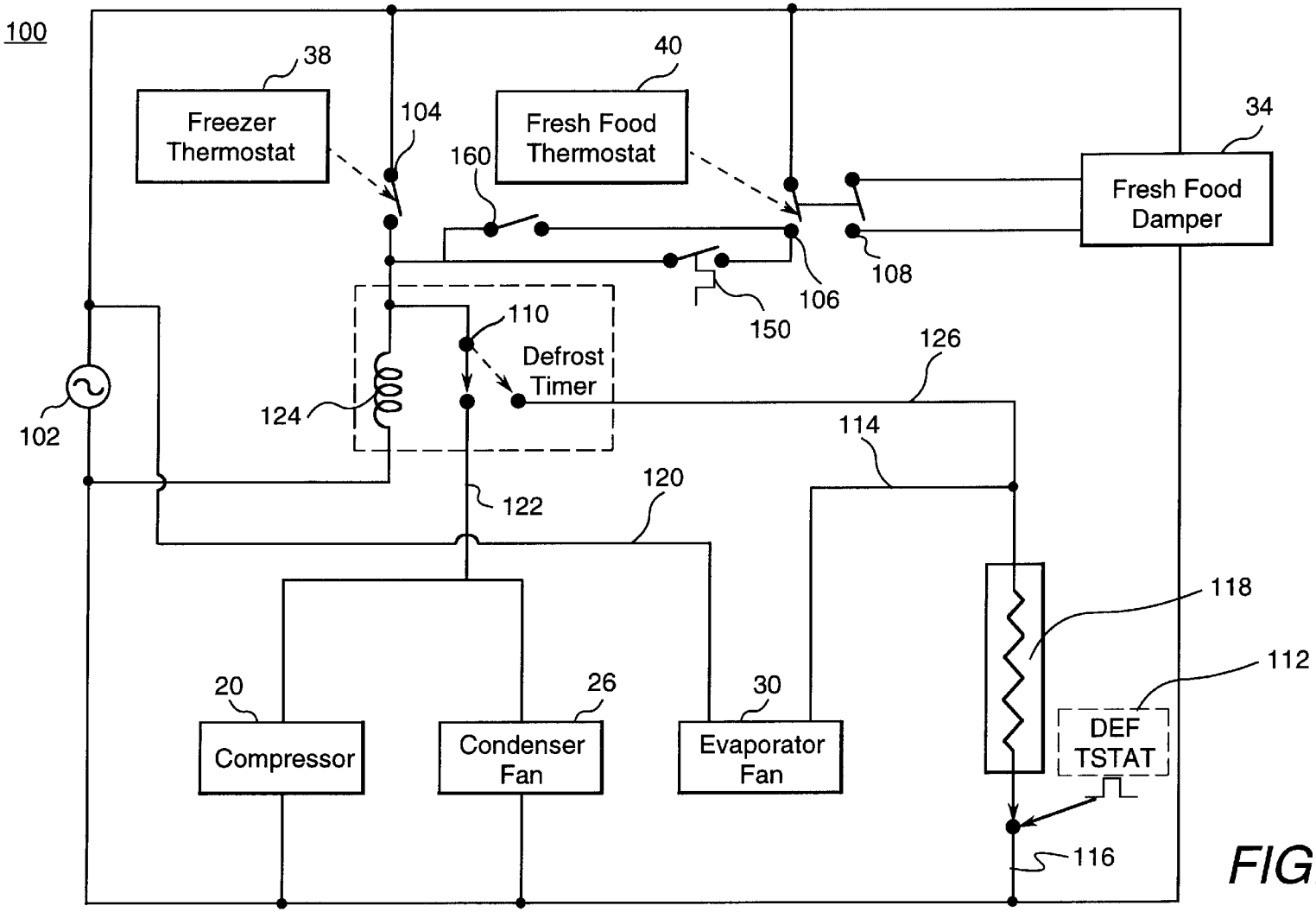
FIG. 4 is another schematic diagram of a control circuit in accordance with another embodiment of the instant invention.

In accordance with other embodiment of the instant invention, a high load switch 160 is disposed in a branch 162 interconnecting fresh food thermostat switch 106 and branch 122, as shown in FIG. 4. High load switch 160 is typically a slide switch disposed so as to be accessible to a system user. If a system user selects a high load mode of operation, high load switch 160 is moved to a closed position. When high load switch 160 is in a closed position, branch 162 shorts across fresh food interlock switch 150 or other intermediate switch so as to connect fresh food thermostat switch 106 and branch 122. Accordingly, if high load switch 160 is in a closed position and fresh food thermostat 40 is calling for cooling, fresh food thermostat switch 106 is in a closed position and power source 102 energizes compressor 20 and condenser fan 26 providing cooling to fresh food compartment.

Figure 5:
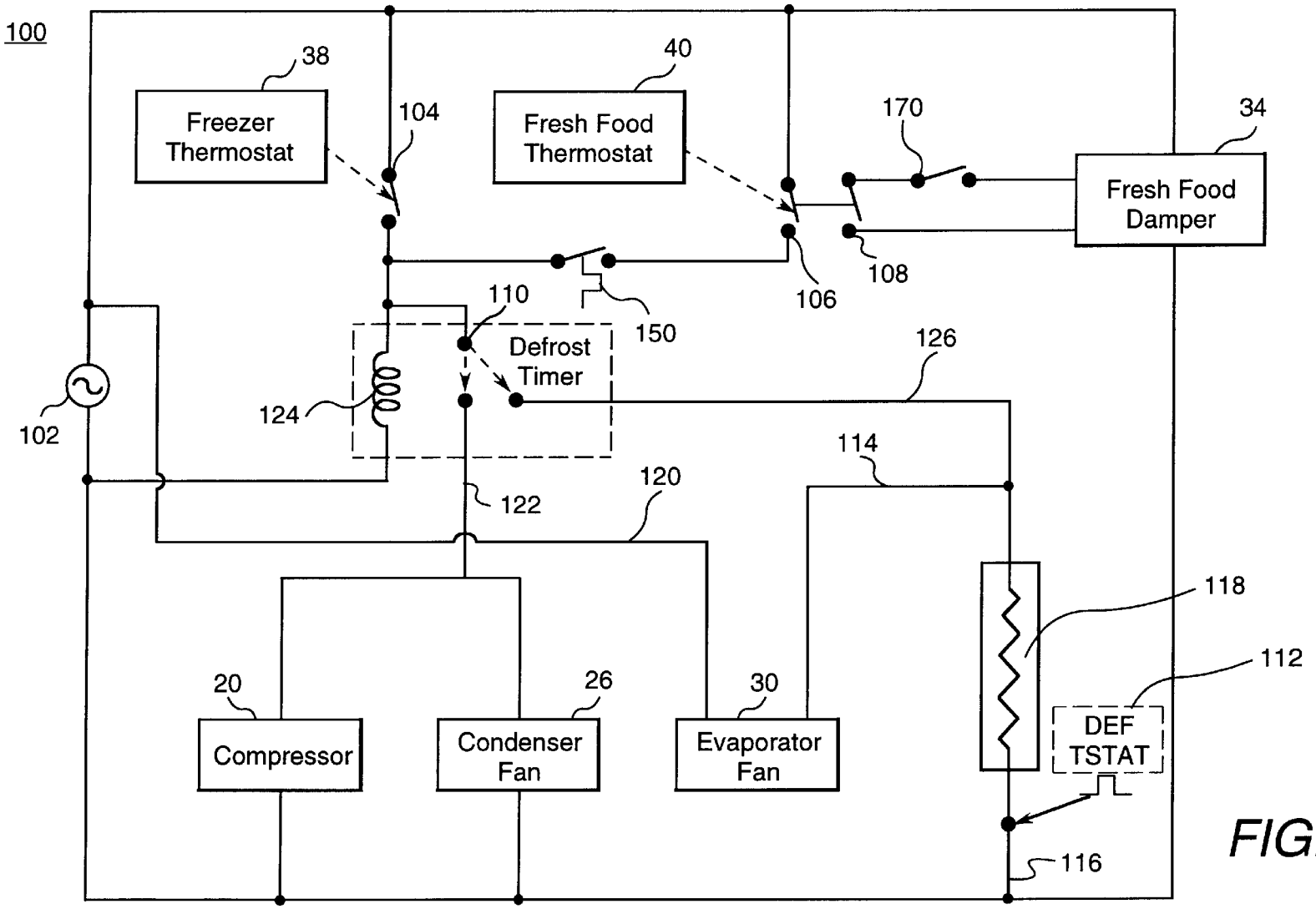
FIG. 5 is another schematic diagram of a control circuit in accordance with another embodiment of the instant invention.

In another embodiment of the instant invention, circuit 100 further comprises a defrost bimetal switch 170 disposed between fresh food damper switch 108 and fresh food damper 34, as shown in FIG. 5. If the temperature rises above a predetermined level, for example during a defrost, defrost bimetal switch 170 will switch from a normally closed position to an open position disabling the ability of fresh food thermostat 40 to open fresh food damper 34 when fresh food thermostat 40 call for cooling. By disabling the ability to open damper 34, convection heating of fresh food compartment 16 is prevented during a defrost event. When the temperature drops below a predetermined level, defrost bimetal switch 108 switches back to a closed position and restores conventional control back to fresh food thermostat 40. This feature permits rapid freezer compartment 14 recovery following a defrost event by delaying the fresh food load until evaporator 20 and freezer compartment 14 have been sufficiently cooled.

Figure 6:
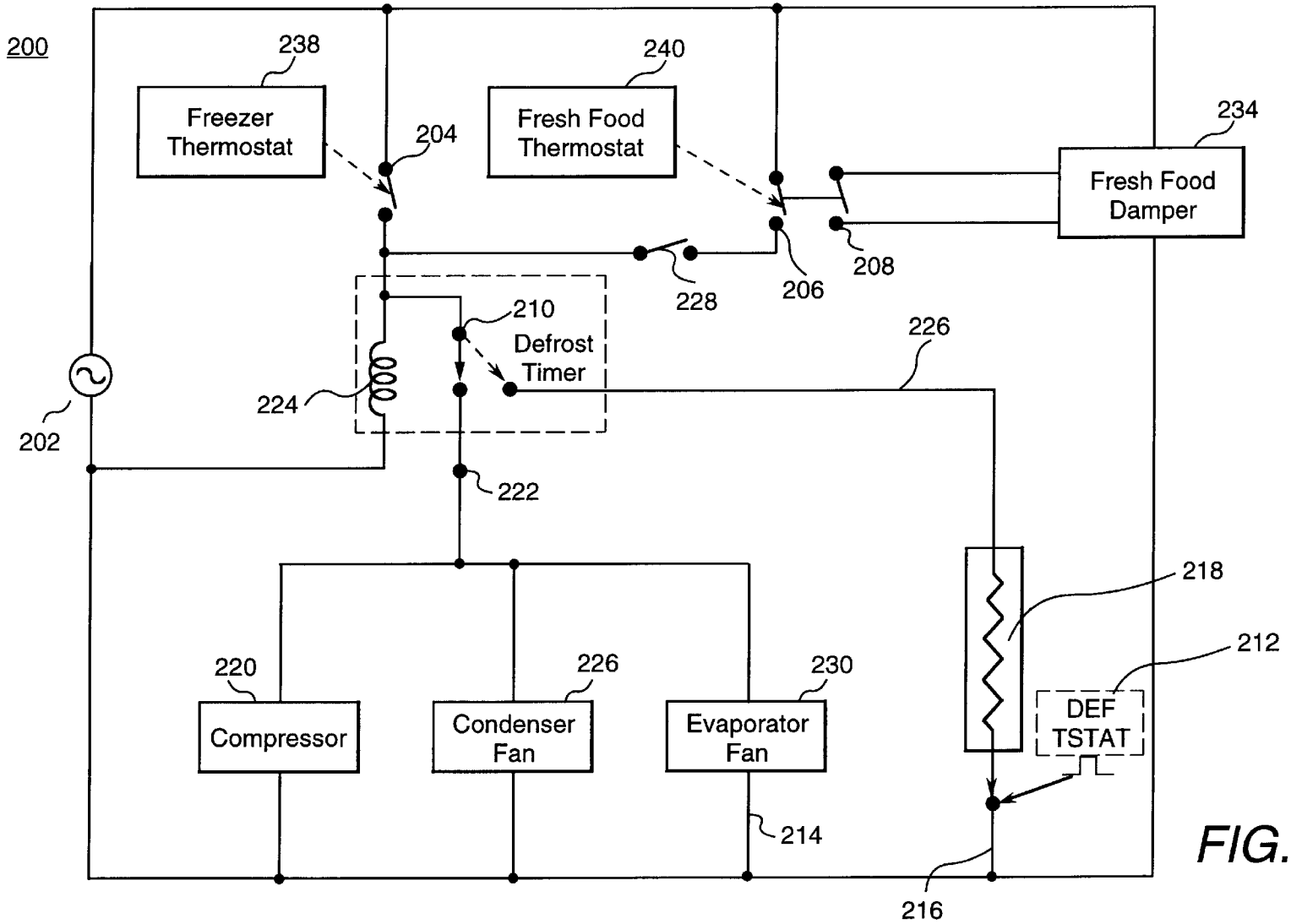
FIG. 6 is another schematic diagram of a control circuit in accordance with another embodiment of the instant invention.

In accordance with another embodiment of the instant invention, a control circuit 200 includes a power source 202, a freezer thermostat switch 204, a fresh food thermostat switch 206, a fresh food damper switch 208, a defrost timer switch 210, and a defrost thermostat 212, as shown in FIG. 6.

Freezer thermostat switch 204 is switched between an open state and a closed state in response to freezer thermostat 238. Specifically, when freezer thermostat 238 is satisfied (the temperature in freezer compartment 14 is below a preset freezer temperature level), freezer thermostat switch 204 is in an open position. Alternatively, when freezer thermostat 238 demands cooling (the temperature in freezer compartment 14 is above a preset freezer temperature level), freezer thermostat switch 204 is switched to a closed position. When freezer thermostat switch 204 is switched to a closed position, a branch 222 is energized by power source 202 and in turn compressor 220, evaporator fan 230 and condenser 226 are energized. Compressor 220, evaporator fan 230 and condenser fan 226 remain energized until freezer thermostat 238 is satisfied and freezer thermostat switch 204 switches back to an open position disconnecting branch 222 from power source 202.

A timer motor 224 runs whenever compressor 220 is energized and accumulates compressor run time. After a predetermined amount of compressor run time, defrost timer switch 210 switches to a second state so as to energize branch 226 and heater 218. Heater 218 heats evaporator and freezer compartment to melt unwanted ice buildup thereon. When defrost thermostat 212 reaches a predetermined set point, thermostat 212 switches to an open position and heater 218 is disabled. When timer motor 224 indexes the timer through the defrost period, compressor 220 and condenser fan 226 are energized.

Fresh food thermostat switch 206 is switched between an open state and a closed state in response to fresh food thermostat 240. Specifically, when fresh food thermostat 240 is satisfied (the temperature in fresh food compartment 16 is below a preset fresh food temperature level), fresh food switch 206 is in an open position. Alternatively, when fresh food thermostat 240 demands cooling (the temperature in fresh food compartment 16 is above a preset fresh food temperature), fresh food switch 206 is switched to a closed position. When fresh food thermostat switch 206 is switched to a closed position, branch 222 is energized by power source 202 and in turn compressor 220, evaporator fan 230 and condenser fan 226 are energized. Compressor 220 and condenser fan 226 remain energized until fresh food thermostat 240 is satisfied and fresh food thermostat switch 206 switches back to an open position disconnecting branch 222 from power source 202. Fresh food damper switch 208 and fresh food thermostat switch 206 typically comprise a double pole single throw switch such that when fresh food thermostat switch 206 is switched between states, fresh food damper switch 208 is correspondingly switched between states. Accordingly, when fresh food thermostat switch 206 is in an open position, fresh food damper switch 208 is also in an open position and fresh food damper 234 is not energized. When fresh food thermostat switch 206 is in a closed position, fresh food damper switch 208 is also in a closed position and fresh food damper 234 is energized.

In accordance with one embodiment of the instant invention, an energy saver switch 228 is disposed between fresh food thermostat switch 206 and branch 222, as shown in FIG. 6. Energy saver switch 228 is typically a slide switch disposed such that it is accessible to a system user. If a system user selects an energy savings mode of operation, energy saver switch 228 is moved to an open position. When energy saver switch 228 is in an open position and fresh food thermostat 240 demands cooling, fresh food switch 206 is switched to a closed position, branch 222 is not energized and in turn compressor 220, evaporator fan 230 and condenser fan 226 are not energized. Accordingly, when a system user slides energy saver switch 228 to an open position fresh food thermostat 240 is prevented from activating the hermetic loop, thereby saving energy.

Since fresh food thermostat switch 206 and fresh food damper switch 208 are correspondingly switched between states, when fresh food switch 206 is switched to a closed position, damper switch 208 is also switched to a closed position. Accordingly, damper fresh food 234 is energized enabling damper 234 to move between an open and closed position to selectively allow cool air from freezer compartment to fresh food compartment.

Therefore, when energy saver switch 228 is opened by a system user, fresh food thermostat 206 cannot activate the hermetic loop. Fresh food compartment 16, therefore, must utilize cool air from freezer compartment 14 to cool contents therein through passage 32.

Figure 7:
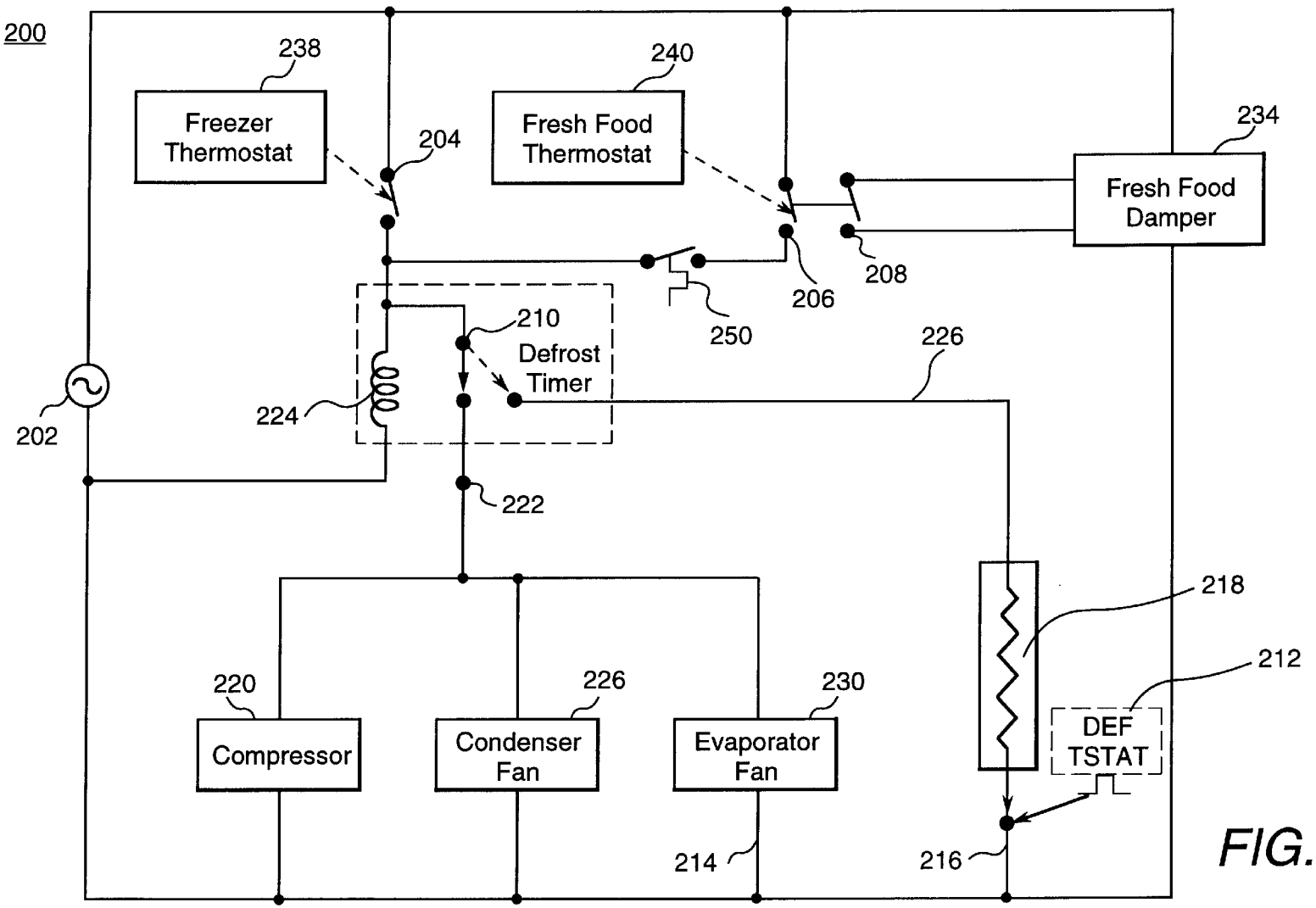
FIG. 7 is another schematic diagram of a control circuit in accordance with another embodiment of the instant invention.

In accordance with another embodiment of the instant invention, a fresh food interlock switch 250 is disposed between fresh food thermostat switch 206 and branch 222, as shown in FIG. 7.

Fresh food interlock switch 250 is typically a bimetal switch disposed adjacent to a suction line return to compressor 220. When fresh food interlock switch 250 is in an open position and fresh food thermostat 240 demands cooling, fresh food thermostat switch 206 is switched to a closed position, but branch 222 is not energized and in turn compressor 220, evaporator fan 230 and condenser fan 226 are not energized. Accordingly, if fresh food thermostat 206 calls for cooling, only damper 234 will open and compressor 220, evaporator fan 230 and condenser fan 226 will not be activated.

When freezer thermostat 238 demands cooling, freezer thermostat switch 204 is switched to a closed position and branch 222 is energized by power source 202 and in turn compressor 220, evaporator fan 230 and condenser fan 226 are energized. When compressor 220 is energized and cooling begins, the suction line return to compressor 220 cools down. If the suction line return temperature drops below a preset temperature, fresh food interlock switch 250 will switch to a closed position.

If fresh food interlock switch 250 is switched to a closed position, and fresh food thermostat 240 is also calling for cooling, i.e. fresh food thermostat switch 206 is in a closed position, fresh food interlock switch 250 will remain in a closed position until both freezer thermostat 238 and fresh food thermostat 240 are satisfied. Once freezer thermostat 238 is satisfied, freezer thermostat switch 204 will switch back to an open position. If fresh food thermostat 240 is simultaneously calling for cooling, fresh food interlock switch 250 will remain in a closed position allowing fresh food thermostat 240 to control the hermetic loop. Once fresh food thermostat 240 is satisfied, fresh food thermostat switch 206 will switch back to an open position and fresh food interlock switch 250 is switched back to an open position.

This fresh food interlock embodiment prevents excessive compressor shut down and start up by allowing fresh food thermostat 240 to have control of the hermetic loop only when compressor 220 is already in use to satisfy freezer thermostat 238.

Figure 8:
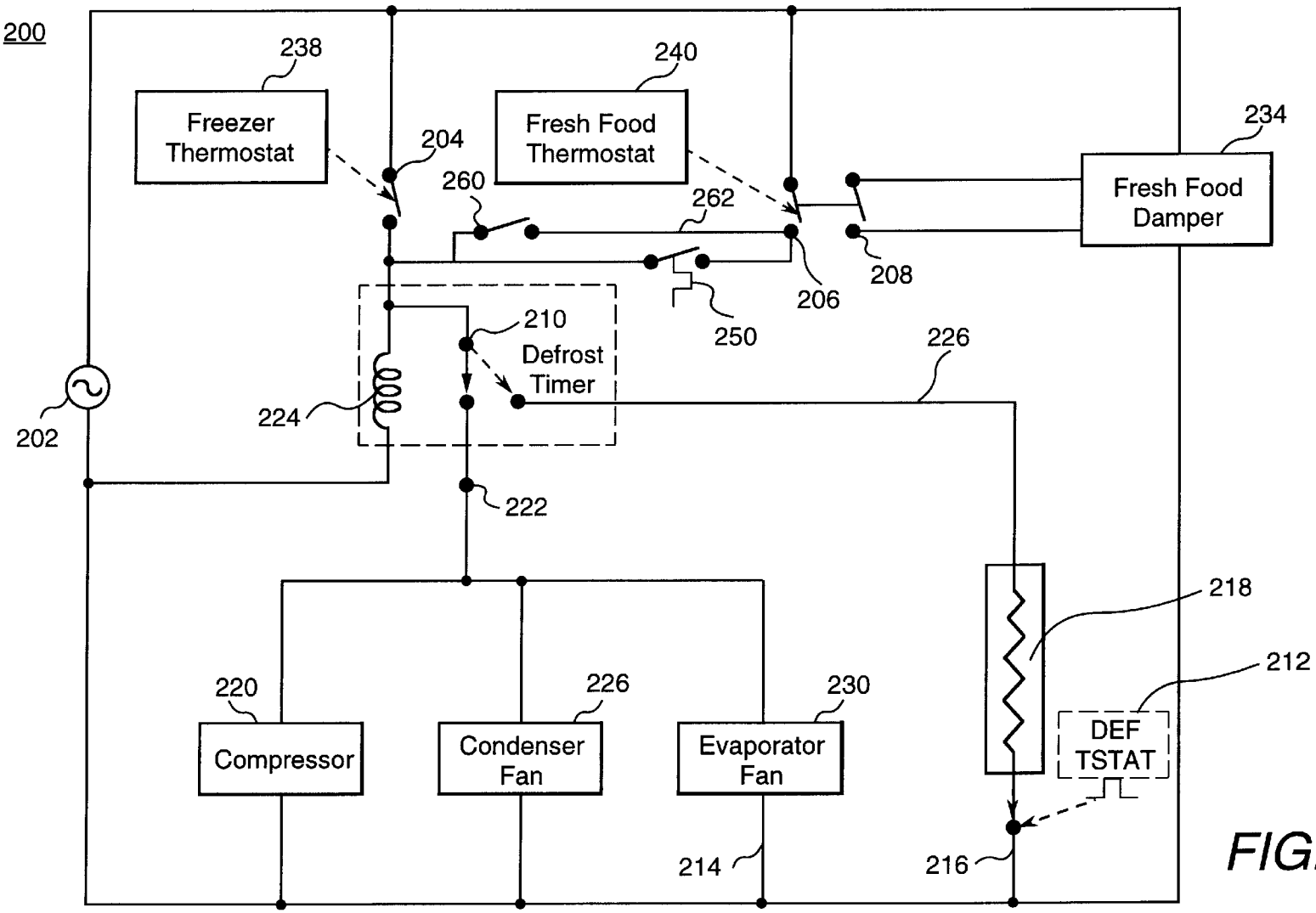
FIG. 8 is another schematic diagram of a control circuit in accordance with another embodiment of the instant invention.

In accordance with other embodiment of the instant invention, a high load switch 260 is disposed in a branch 262 interconnecting fresh food thermostat switch 206 and branch 222, as shown in FIG. 8. High load switch 260 is typically a slide switch disposed so as to be accessible to a system user. If a system user selects a high load mode of operation, high load switch 260 is moved to a closed position. When high load switch 260 is in a closed position, branch 262 shorts across fresh food interlock switch 250 or other intermediate switch so as to connect fresh food thermostat switch 206 and branch 222. Accordingly, if high load switch 260 is in a closed position and fresh food thermostat 240 is calling for cooling, fresh food thermostat switch 206 is in a closed position and power source 202 energizes compressor 220, evaporator fan 230 and condenser fan 226 providing cooling to fresh food compartment.

Figure 9:
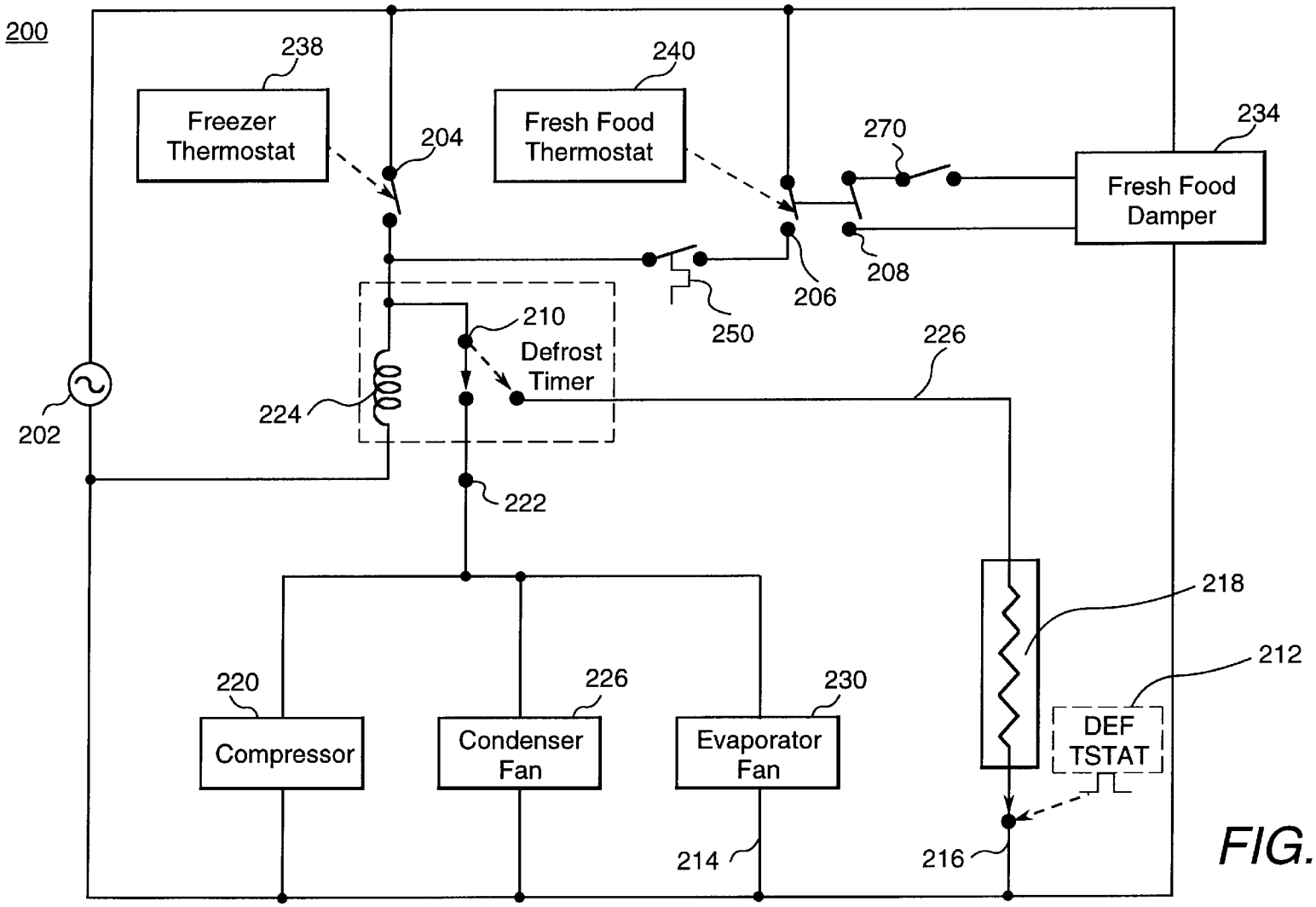
FIG. 9 is another schematic diagram of a control circuit in accordance with another embodiment of the instant invention.

In another embodiment of the instant invention, circuit 200 further comprises a defrost bimetal switch 270 disposed between fresh food damper switch 208 and fresh food damper 234, as shown in FIG. 9. If the temperature rises above a predetermined level, for example during a defrost, defrost bimetal switch 270 will switch from a normally closed position to an open position disabling the ability of fresh food thermostat 240 to open fresh food damper 234 when fresh food thermostat 240 calls for cooling. By disabling the ability to open damper 234, convection heating of fresh food compartment 16 is prevented during a defrost event. When the temperature drops below a predetermined level, defrost bimetal switch 208 switches back to a closed position and restores conventional control back to fresh food thermostat 240. This feature permits rapid freezer compartment 14 recovery following a defrost event by delaying the fresh food load until evaporator and freezer compartment have been sufficiently cooled.

Figure 10:
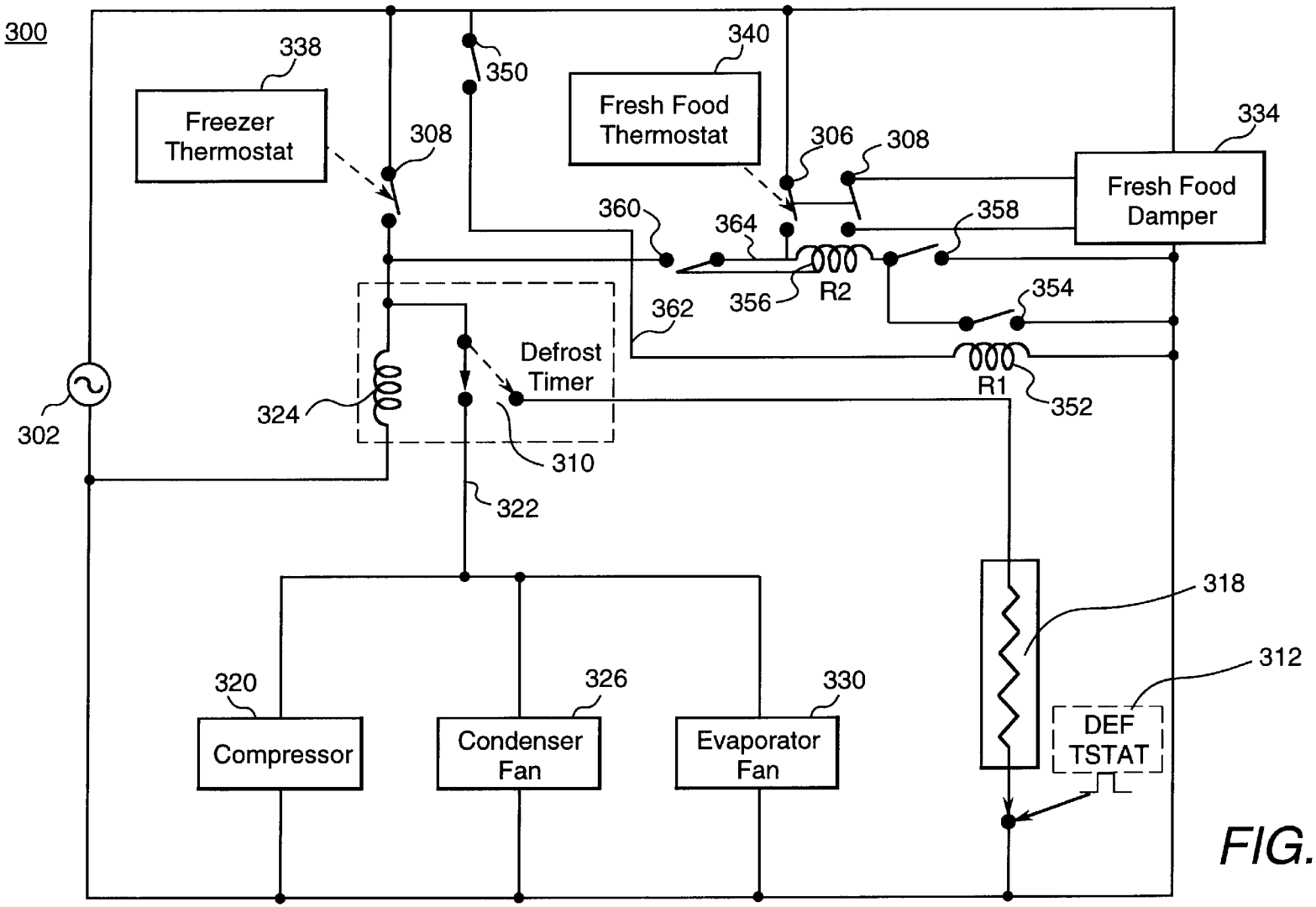
FIG. 10 is another schematic diagram of a control circuit in accordance with another embodiment of the instant invention.

A door activated load switching circuit 300 of the instant invention is shown in FIG. 10. Door activated load switching circuit 300 comprises a fresh food door switch 350, a first relay 352, a first relay switch 354, a second relay 356, a second relay switch 358, and a third relay switch 360.

Fresh food door switch 350 is switched from an open position to a closed position each time fresh food door 11 (FIG. 1) is opened. When fresh food door switch 350 switches to a closed position, a branch 362 is energized by power source 302. Accordingly, when fresh food door switch 350 switches to a closed position, first relay 352 disposed in branch 362 is energized. First relay 352 is coupled to first relay switch 354. When first relay 352 is energized, first relay switch 354 is switched from an open position to a closed position. When first relay switch 354 is closed, power flows to a branch 364 having second relay 356. Second relay 356 is coupled to second relay switch 358 and third relay switch 360. If fresh food thermostat 340 is not calling for cooling, fresh food thermostat switch 306 will be in an open position and branch 364 will not be energized as the circuit is not completed.

If, however, fresh food thermostat 340 is calling for cooling and fresh food thermostat switch 306 is switched to a closed position, branch 306 will be energized. When branch 306 is energized, second relay 356 is energized and in response, second relay switch 358 and third relay switch 360 are switched to a closed position allowing fresh food thermostat 340 to take control of the hermetic loop. Even though fresh food switch 350 may be switched back to an open position by the closing of door 11 (FIG. 1), second relay switch 360 remains in a closed position and fresh food thermostat controls compressor 320, condenser fan 326, and evaporator fan 330 until fresh food thermostat is satisfied.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A control circuit for a refrigeration system disposed within an outer cabinet having a freezer compartment, a fresh food compartment, a compressor, a condenser fan and an evaporator, said control circuit comprising:

a freezer thermostat disposed within said freezer compartment to sense temperature therein;

a fresh food thermostat disposed within said fresh food compartment to sense temperature therein;

an evaporator fan;

a freezer thermostat switch that is switched between an open state and a closed state in response to temperature signals generated from said freezer thermostat;

a fresh food thermostat switch that is switched between an open state and a closed state in response to temperature signals generated from said fresh food thermostat; and an energy saver switch disposed between said fresh food thermostat switch and a power source which energy saver switch is switched between an open state and a closed state;

wherein said energy saver switch is selectively disposed in an open position and said fresh food thermostat demands cooling wherein said compressor and said condenser fan are not energized;

wherein said energy switch is selectively disposed in a closed position said fresh food thermostat demands cooling and said compressor and said condenser fan are energized.

2. A control circuit in accordance with claim 1, wherein said evaporator fan is continuously energized as long as a defrost thermostat is in a closed switch position.

3. A control circuit in accordance with claim 1, wherein said evaporator fan is energized with said compressor and said condenser fan.

4. A control circuit in accordance with claim 1, wherein said energy saver switch is a slide switch disposed so as to be accessible to a system user.

5. A control circuit in accordance with claim 1, wherein said fresh food thermostat switch and a fresh food damper switch comprise a double pole single throw switch.

6. A control circuit in accordance with claim 5, wherein said energy saver switch is selectively disposed in an open position and said fresh food thermostat cannot energize said compressor or said condenser fan and said fresh food damper switch is disposed in an open position such that cool air from said freezer compartment is utilized to cool said fresh food compartment.

7. A control circuit in accordance with claim 1 further comprising a high load switch disposed in a branch connecting fresh food thermostat switch and said power source wherein said high load switch is selectively disposed in a closed position and said branch shorts across said energy saver switch so as to connect said fresh food thermostat switch and said power source enabling said fresh food thermostat to energize said condenser fan and said compressor if fresh food compartment cooling is needed.

8. A control circuit in accordance with claim 7, wherein said high load switch is a slide switch disposed so as to be accessible to a system user.

9. A control circuit in accordance with claim 5, further comprising a defrost bimetal switch disposed between said fresh food damper switch and a fresh food damper such that if the temperature rises above a preset temperature said defrost bimetal switch will switch from a normally closed position to an open position disabling the ability of said fresh food thermostat to open said fresh food damper until the temperature drops below a preset temperature.

10. A control circuit for a refrigeration system disposed within an outer cabinet having a freezer compartment, a fresh food compartment, a compressor, a condenser fan, and an evaporator, said control circuit comprising:

a freezer thermostat disposed within said freezer compartment to sense temperature therein;

a fresh food thermostat disposed within said fresh food compartment to sense temperature therein;

an evaporator fan;

a freezer thermostat switch that is switched between an open state and a closed state in response to temperature signals generated from said freezer thermostat;

a fresh food thermostat switch that is switched between an open state and a closed state in response to temperature signals generated from said fresh food thermostat; and a fresh food interlock switch disposed between said fresh food thermostat switch and a power source and adjacent to a suction line return to said compressor, which fresh food interlock switch is switched between an open state and a closed state;

wherein said freezer thermostat demands cooling said compressor and said condenser fan are energized and said suction line cools down and in response to said temperature of said suction line dropping below a preset temperature said fresh food interlock switch switchs to a closed position enabling said fresh food thermostat to energize said condenser fan and said compressor if fresh food compartment cooling is needed.

11. A control circuit in accordance with claim 10, wherein said evaporator fan is continuously energized as long as a defrost thermostat is in a closed switch position.

12. A control circuit in accordance with claim 10, wherein said evaporator fan is energized along with said compressor and said condenser fan.

13. A control circuit in accordance with claim 10 wherein said fresh food interlock switch is a bimetal switch.

14. A control circuit in accordance with claim 10, wherein said fresh food thermostat switch and a fresh food damper switch comprise a double pole single throw switch.

15. A control circuit in accordance with claim 10, wherein said fresh food interlock switch is disposed in an open position and said fresh food thermostat can not energize said compressor or said condenser fan and said fresh food damper switch is disposed in an open position such that cool air from said freezer compartment is utilized to cool said fresh food compartment.

16. A control circuit in accordance with claim 10 further comprising a high load switch disposed in a branch connecting said fresh food thermostat switch and said power source wherein said high load switch is selectively disposed in a closed position and said branch shorts across said fresh food interlock switch so as to connect said fresh food thermostat switch and said power source enabling said fresh food thermostat to energize said condenser fan and said compressor if fresh food compartment cooling is needed.

17. A control circuit in accordance with claim 16, wherein said high load switch is a slide switch disposed so as to be accessible to a system user.

18. A control circuit in accordance with claim 14, further comprising a defrost bimetal switch disposed between said fresh food damper switch and said fresh food damper such that if the temperature rises above a preset temperature said defrost bimetal switch will switch from a normally closed position to an open position disabling the ability of said fresh food thermostat to open said fresh food damper until the temperature drops below a preset temperature.

19. A control circuit for a refrigeration system disposed within an outer cabinet having a freezer compartment, a freezer door, a fresh food compartment, a fresh food door, a compressor, a condenser fan, and an evaporator, said control circuit comprising:

a freezer thermostat disposed within said freezer compartment to sense temperature therein;

a fresh food thermostat disposed within said fresh food compartment to sense temperature therein;

an evaporator fan;

a freezer thermostat switch that is switched between an open state and a closed state in response to temperature signals generated from said fresh food thermostat;

a fresh food thermostat switch that is switched between an open state and a closed state in response to temperature signals generated from said fresh food thermostat; and a fresh food door switch;

a first relay and a second relay;

a first relay switch coupled to said first relay, a second relay switch and a third relay switch each coupled to said second relay;

wherein said fresh food door switch is switched from an open position to a closed position when said fresh food door is opened energizing said first relay and correspondingly energizing said first relay switch;

wherein if said fresh food thermostat is calling for cooling when said first relay is energized, fresh food thermostat switch is switched to a closed position energizing said second relay and correspondingly said second relay switch and said third relay switch enabling said fresh food thermostat to energize said condenser fan and said compressor.

* * * * *